United States Patent [19]

Wakimura

[11] Patent Number: 4,479,327

[45] Date of Patent: Oct. 30, 1984

[54] ELECTRIC CAR WITH WINCH HAVING AUTOMATIC SHUTOFF

[75] Inventor: Kakuichi Wakimura, Tokyo, Japan

[73] Assignee: Mitsuwa Kogyo Co., Ltd., Tokyo, Japan

[21] Appl. No.: 439,399

[22] Filed: Nov. 5, 1982

[30] Foreign Application Priority Data

Jul. 10, 1982 [JP] Japan ..... 57-104756[U]

[51] Int. Cl.[3] ..... A63H 17/12

[52] U.S. Cl. ..... 446/427; 446/462; 446/484

[58] Field of Search ..... 46/251, 40, 206, 39; 180/53 FE, 53 B, 53 D; 192/74, 48.91

[56] References Cited

U.S. PATENT DOCUMENTS

| | | | |
|---|---|---|---|
| 2,753,736 | 7/1956 | Mitchell | 192/48.91 |
| 3,529,479 | 9/1970 | Ryan et al. | 46/206 |
| 3,590,523 | 7/1971 | Riesgraf | 46/251 |
| 3,682,477 | 8/1972 | Harkins | 46/251 |
| 4,152,866 | 5/1979 | Suda | 46/251 |
| 4,216,612 | 8/1980 | Erickson et al. | 46/251 |
| 4,271,378 | 6/1981 | Knauff | 46/251 |

*Primary Examiner*—F. Barry Shay

[57] ABSTRACT

A toy car with a winch mechanism is disclosed, which comprises a clutch shaft associated with a driving shaft of a motor and movable axially with an oscillating rod, a winch drum shaft and a wheel driving shaft supported on a frame, a clutch gear on the clutch shaft, driving gears on the winch drum shaft and the wheel driving shaft for selectively meshing with the clutch gear, a winch rope with a hook secured to the winch drum shaft, a brush resiliently contacted with the winch drum shaft, a rope guiding frame movably contacted with the brush, and a switch for discontinuing the hoisting operating of the winch.

The toy car with the winch mechanism thus constructed allows both forward movement of the car and the hoisting operation of the winch by use of a single motor, and prevents the motor from being damaged or burnt out by overload.

3 Claims, 6 Drawing Figures

ELECTRIC CAR WITH WINCH HAVING AUTOMATIC SHUTOFF

FIELD OF THE INVENTION

This invention relates to a toy car with a winch mechanism and more particularly to a toy car with a winch mechanism in which forward movement of the car and hoisting operation of the winch may be conveniently carried out with a single motor.

BACKGROUND OF THE INVENTION

Heretofore, a toy car and a winch mechanism have been operated separately with different motors. Further, a winch mechanism on the toy car is not available which enables a hoisting motor to be automatically deenergized when the hoisting operation has been finished. Thus, the winch mechanism and the hoisting motor are often damaged or burnt out by overload.

Now, the inventor has succeeded in creating a novel toy car with a winch mechanism in which both movement of the car and hoisting operation of the winch may be conveniently conducted with a single motor and in which a hoisting motor is automatically deenergized immediately after the hoisting operation has been terminated, ensuring a long life for the toy car.

SUMMARY OF THE INVENTION

An object of the invention is to provide a toy car with a winch mechanism, which comprises a clutch shaft associated with a driving shaft of a motor, said clutch shaft being axially movable through an oscillating rod; a winch drum shaft and a wheel driving shaft carried on a frame and in parallel to the clutch shaft; a clutch gear of the clutch shaft; driving gears arranged on the winch drum shaft and the wheel driving shaft for separately meshing with the clutch gear through axial movement of the clutch shaft, said wheel driving shaft being operatively associated with each of wheels; a winch rope with a hook secured thereto and to the winch drum shaft; a brush resiliently contacted with the winch drum shaft; a movable rope guiding frame adapted to contact the brush in one of its directions of movement; and a switch comprising the brush and the winch drum shaft for discontinuing the hoisting operation of the winch on deenergizing the motor which occurs on breaking contact between the brush and the winch drum shaft.

DETAILED DESCRIPTION OF THE INVENTION

In accordance with the invention, the driving of the toy car and the hoisting operation of the winch may be carried out by operating only the oscillating rod, the hoisting operation being automatically discontinued upon completion of the hoisting operation.

The invention will be described in more detail with reference to the accompanying drawings.

PREFERRED EMBODIMENT OF THE INVENTION

Figure 2:
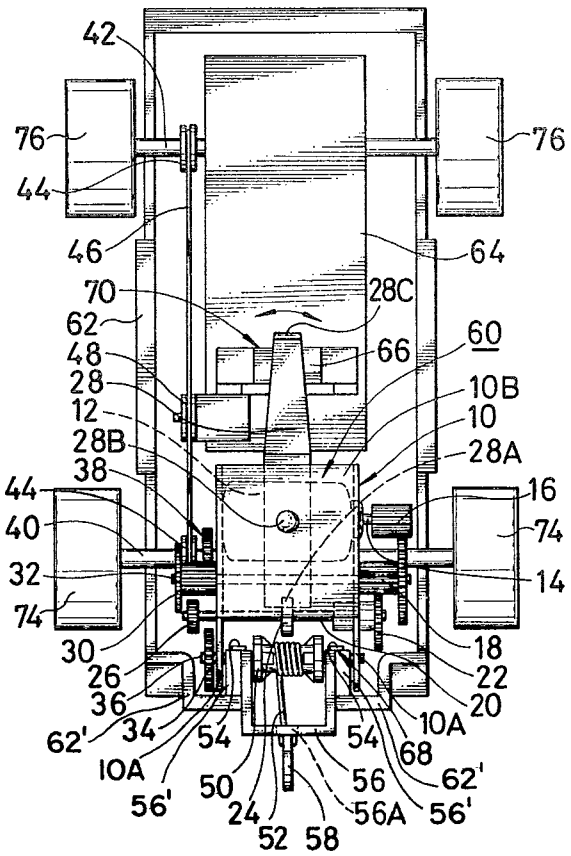
FIG. 2 is a plan view of the toy car of FIG. 1 with removing the outer frame.
Figure 1:
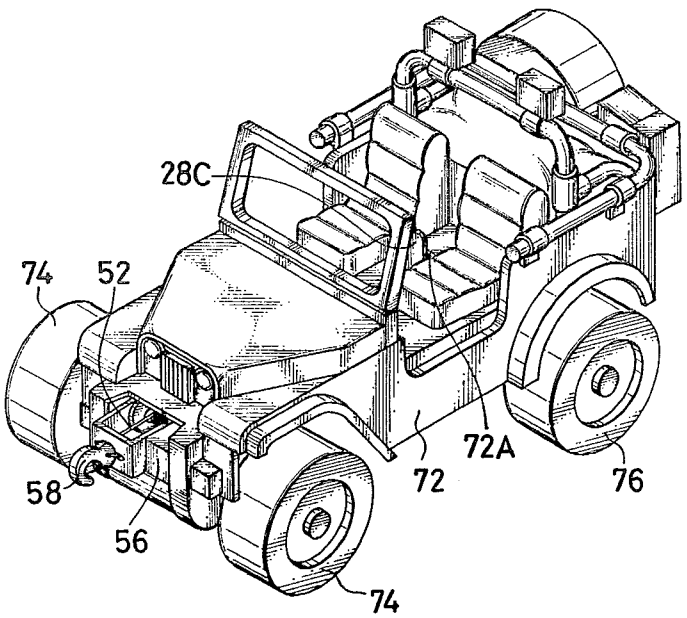
FIG. 1 is a perspective view of a toy car with a winch mechanism according to the invention.
Figure 3:
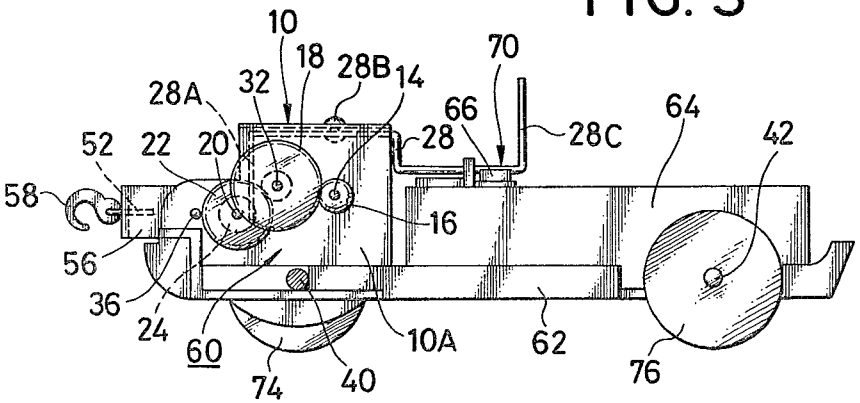
FIG. 3 is a side view from the right side.

Referring to the drawings, a frame 10 is made of a rectangularly bent steel sheet. On the frame 10 is secured a motor 12 with its driving shaft 14 extending outwardly through one of side walls 10 A of the frame 10. The driving shaft 14 is provided with a driving gear 16 meshing with a reducing gear 18 which in turn is meshed with a follower gear 22 fixed to one end of a clutch shaft 20, thereby associating the driving shaft 14 with the clutch shaft 20.

The clutch shaft 20 is supported on the side wall 10 A of the frame 10 and is axially movable. At its center is fixed an engaging disc 24, while a clutch gear 26 is fixed to the opposite end of the clutch shaft 20.

Figure 5:
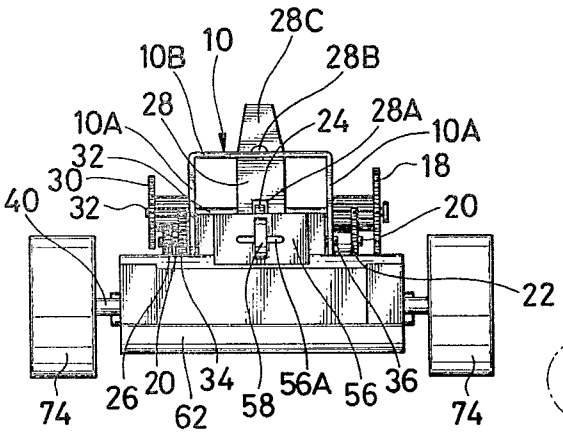
FIG. 5 is a front view of the toy car according to the invention.

Under a top wall 10 B of the frame 10 is arranged an oscillating rod 28 with its center part serving as a supporting point 28 B. As seen in FIG. 5, the oscillating rod 28 has its engaging notch 28 A (see FIGS. 2 and 5) engaged with the engaging disc 24. Thus, oscillation of the rod 28 allows the clutch shaft 20 to move axially.

In the vicinity of the clutch gear 26 are arranged on the side wall 10 A a wheel driving shaft 32 with a wheel driving gear 30, and a winch drum shaft 36 with a winch drum driving gear 34, which gears 30 and 34 are selectively meshed with the clutch gear 26 through axial movement of the oscillating rod 28.

The wheel driving shaft 32 is associated through a row of reducing gears 38 with a front wheel shaft 40. The row of the reducing gears 38 is turnably arranged for drive by the wheel driving shaft 32 at an end thereof opposite to the wheel driving gear 30 and is designed to reduce the rotational speed of the front wheel shaft 40.

Figure 4:
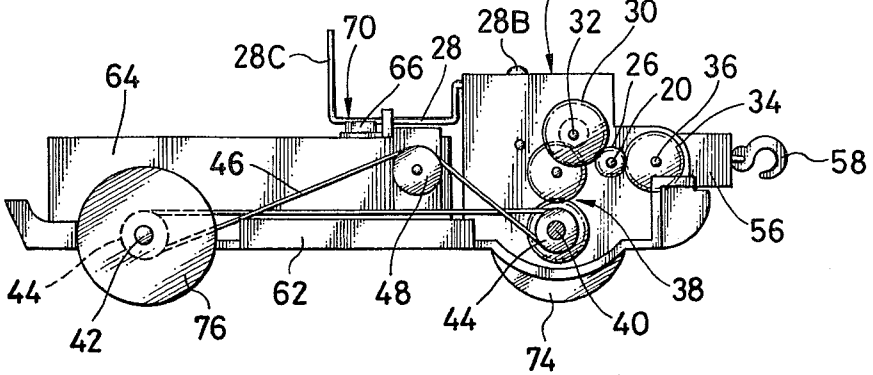
FIG. 4 is a side view from the left side.

As described hereinafter, a front wheel shaft 40 and a rear wheel shaft 42 carried on a chassis 62 are fixedly provided with respective pulleys 44, 44 between which is extended a rubber belt 46. Further, the chassis 62 is provided with a take-up pulley 48 (see FIGS. 2 and 4) for stretching the rubber belt 46.

The winch drum shaft 36 supports a winch drum 50 made of plastics to which is fixed a winch rope 52.

Figure 6:
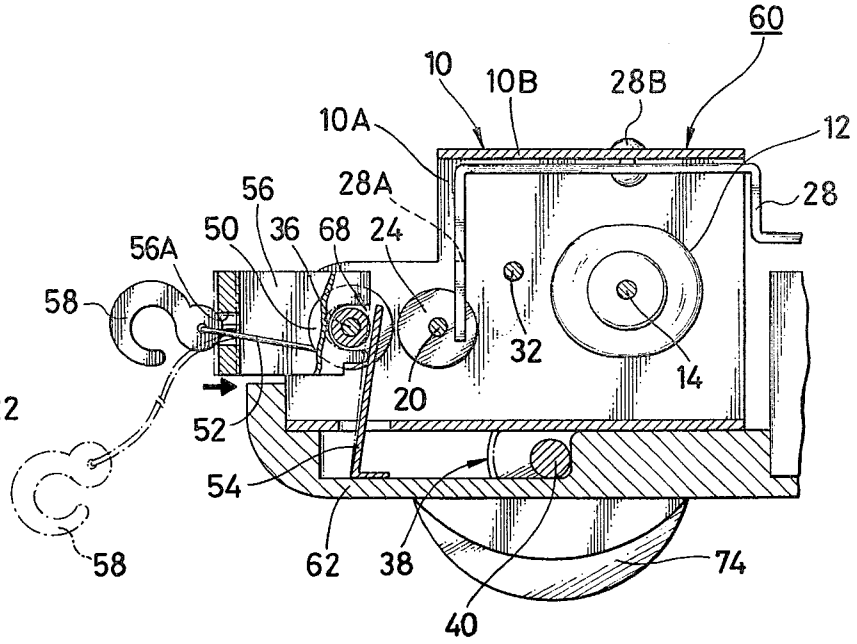
FIG. 6 is a partially broken side view from the right side upon completion of the hoisting operation of the winch.

As more clearly shown in FIG. 6 behind the winch drum shaft 36 is arranged a brush 54 with its brushing surface being resiliently contacted with the drum shaft 36. In front of the drum shaft 36, as seen in FIGS. 5 and 6, a winch rope guiding frame 56 is arranged between the side walls 10 A and supported at the front end 62' of the chassis 62 for forward and rearward movement relative thereto. The guiding frame 56 at its rear end is contacted with the brush 54, while near its center is provided with a hole 56 A for guiding the winch rope 52 therethrough. The guiding frame 56 has lateral projections 56' on either side thereof and serves as a stop for the guiding frame 56 when moved forwardly by resilient brush 54 on unwinding the rope from the winch drum 50.

The winch rope 52 is made of a stranded thread, a braided rope or a chain, to which at is free end is fixed a hook 58 of a size larger than a diameter of the hole 56 A.

A driving mechanism 60 is arranged in front of a chassis 62 of the toy car, such as a jeep. The driving mechanism 60 at its rear is provided with a battery case 64 (see FIG. 2) integral with the chassis 62. Above the battery 64 is arranged a plate contact 66 which is adapted to be contacted with one side of the oscillating rod 28 upon actuation thereof. The plate contact 66 is made of a copper strip and bent at its both ends obliquely upward.

One of terminals of the motor 12 is connected to a battery (not shown), while the other is connected to the plate contact 66 adapted to be engaged by the oscillating rod 28 and forming a starting switch 70 therewith. A terminal of the battery opposite to the terminal connected to the motor 12 is connected to the brush 54. Since the frame 10 is made of a conductive steel sheet, the motor 12 is connected to the battery through a switch 68 comprising the brush 54 and the winch drum shaft 36 for discontinuing the winch operation when the brush is separated from the winch drum shaft 36, as described below.

The oscillating rod 28 is bent at its operational section 28 C upwardly, which section 28 C is protruded through an opening 72 A of a body 72, for example in the shape of a jeep, for convenient operation.

To operate the vehicle, the operational section 28C of the oscillating rod 28 is initially moved clockwise as shown by the rightward directed arrow in FIG. 2, to energize the starting switch 70 for starting the motor 12. The clutch shaft 20 is thereby axially moved to the left as viewed in FIG. 2 to allow the clutch gear 26 thereon to mesh with the wheel driving gear 30, thereby to start rotation of front wheels 74. At the same time, on rotation of the front wheels 74 the rubber belt 46 transmits the rotational movement to rear wheels 76, thereby achieving four wheel drive.

For operating the winch, the hook 58 is pulled to extend the rope 52 and then the oscillating rod 28 is moved counterclockwise as viewed in FIG. 2. The counterclockwise movement disengages clutch gear 26 from wheel driving gear 30 but since the rod 28 is in contact with the plate contact 66 the starting motor 12 remains energized but no driving power is supplied to the front and rear wheels of the vehicle. At the same time, the counterclockwise movement of the rod 28 meshes the clutch gear 26 with the winch drum driving gear 34, thereby to start rotation of the winch drum 50. Rotation of the winch drum 50 winds the winch rope 52 around the drum 50. When the slack in the winch rope has been taken up, the hook 58 on continued rotation of drum 50 engages the rope-guiding frame 56 which is pulled backwardly toward the frame 10. The backward movement of the rope-guiding frame 56 separates the brush 54 from engagement with the winch drum shaft 36, thereby opening the switch 68 to terminate operation of the motor 12. Thus, the winch, or hoisting operation is automatically discontinued immediately after the hoisting operation is terminated.

As described hereinabove, in accordance with the invention, the clutch shaft 20 is associated with the driving shaft 14 of the motor 12 and is axially movable through the oscillating rod 28. The winch drum shaft 36 and the wheel driving shaft 32 are supported on the frame 10 in parallel to the clutch shaft 20 and are provided with the driving gears 30, 34 for separately meshing with the clutch gear 26 through axial movement of the clutch shaft 20. The wheel driving shaft 32 effectively drives the wheels 74, 76 (the latter through rubber belt 46) and the winch rope 52 with the hook 58 at the end thereof are effectively pulled toward the winch drum 50 for winding the rope thereon. The toy car and winch mechanism construction according to the invention allow both forward movement of the car and the hoisting operation of the winch with a single motor and on operating the oscillating rod 28.

Further, the brush 54 is resiliently contacted with the winch drum shaft 36 or with the rope-guiding frame 56 depending on the position of the rope guide frame 56. Thus, when the rope guiding frame 56 is moved forwardly by resilient brush 54 relative to the front end 62' of the chassis, as when pulling the rope 52 from the winch drum 50, the brush 54 contacts the winch drum shaft 36. On closing switch 70, the motor 12 rotates the winch drum to wind the rope thereon until the hook 58 engages the rope guiding frame to move it rearwardly relative to the chassis 62' whereby to move the brush 54 out of engagement with the winch drum shaft 36 thereby opening switch 68 to thereby automatically terminate the hoisting operation. Thus, completion of the hoisting operation spontaneously deenergizes the motor, thereby preventing the driving mechanism and the motor from being damaged or burnt out by overload.

Although the invention has been illustrated for the preferred embodiment with reference to the drawings, it will be appreciated to a person skilled in the art that various variations and modifications may be made without departing from the spirit and scope of the invention.

What is claimed is:

1. A toy car with a winch mechanism, which comprises a clutch shaft associated with a driving shaft of a motor, said clutch shaft being axially movable through an oscillating rod; said oscillating rod including electrical contact means to a source of power for energizing said motor; a winch drum shaft and a wheel driving shaft supported on a car frame and in parallel to the clutch shaft; a clutch gear on the clutch shaft; driving gears arranged on the winch drum shaft and the wheel driving shaft for separately meshing with the clutch gear through axial movement of the clutch shaft, said wheel driving shaft being associated with wheels of said car; a winch rope with a hook secured to the winch drum shaft; an electric conductor brush mounted in said car having a brushing surface which is resiliently contacted with the winch drum shaft; a movable winch rope guiding frame mounted on said car, said frame being adapted to move in a forward and backward direction and move said brush upon the backward movement, said electric conductor brush and said winch drum shaft constituting a switch means being released upon said rope guiding frame moving said brush for discontinuing the winch operation; said guiding frame having an opening near its center for guiding said winch rope therethrough; said oscillating rod being movable to a position with its contact means for starting said motor and rotating said winch drum shaft to wind said winch rope thereon until said winch hook engages said rope guiding frame causing it to move in a backward direction; whereby said switch means is released through the winch rope on the rope guiding frame for discontinuing the hoisting operation of the winch, said switch being provided with a switching contact to the electric conductor brush and the winch drum shaft.

2. The toy car with the winch mechanism as claimed in claim 1, wherein a rubber belt is extended over shafts coupling front and rear wheels of the car to provide four wheel drive.

3. The toy car with the winch mechanism as claimed in claim 1, wherein the clutch shaft is associated with the driving shaft of the motor through a row of gears including a reducing gear.

* * * * *